US008022919B2

(12) United States Patent
Kwon et al.

(10) Patent No.: US 8,022,919 B2
(45) Date of Patent: Sep. 20, 2011

(54) LIQUID CRYSTAL DISPLAY AND DRIVING METHOD THEREOF

(75) Inventors: Sun Young Kwon, Gyeongsangbuk-do (KR); Jung Wook Shin, Seoul (KR)

(73) Assignee: LG Display Co., Ltd., Seoul (KR)

( * ) Notice: Subject to any disclaimer, the term of this patent is extended or adjusted under 35 U.S.C. 154(b) by 853 days.

(21) Appl. No.: 11/471,725

(22) Filed: Jun. 21, 2006

(65) Prior Publication Data

US 2007/0152944 A1 Jul. 5, 2007

(30) Foreign Application Priority Data

Dec. 30, 2005 (KR) ..... 10-2005-0134838

(51) Int. Cl.
*G09G 3/36* (2006.01)
*G09G 5/00* (2006.01)

(52) U.S. Cl. ..... 345/100; 345/204

(58) Field of Classification Search ..... 345/98–100
See application file for complete search history.

(56) References Cited

U.S. PATENT DOCUMENTS

| | | | | |
|---|---|---|---|---|
| 5,748,175 | A * | 5/1998 | Shimada et al. | 345/660 |
| 6,181,317 | B1 * | 1/2001 | Taguchi et al. | 345/698 |
| 6,667,730 | B1 * | 12/2003 | Taguchi et al. | 345/99 |
| 6,831,633 | B1 | 12/2004 | Murade | |
| 6,850,305 | B2 * | 2/2005 | Hsieh et al. | 349/144 |
| 2005/0093810 | A1 * | 5/2005 | Ito | 345/100 |
| 2005/0093811 | A1 * | 5/2005 | Ito | 345/100 |
| 2005/0128169 | A1 * | 6/2005 | Kang et al. | 345/87 |

FOREIGN PATENT DOCUMENTS

| | | |
|---|---|---|
| JP | 4-116588 | 4/1992 |
| JP | 2001-100710 | 4/2001 |

* cited by examiner

*Primary Examiner* — Richard Hjerpe
*Assistant Examiner* — Dorothy Harris
(74) *Attorney, Agent, or Firm* — Morgan, Lewis & Bockius LLP

(57) ABSTRACT

A liquid crystal display device includes a liquid crystal display panel having a number of gate lines, a gate driver having a number of gate channels, wherein the number of gate channels is different than the number of gate lines, and a timing controller to apply a gate shift clock signal to the gate driver, the gate shift clock signal having at least one dummy shift clock signal.

9 Claims, 5 Drawing Sheets

LIQUID CRYSTAL DISPLAY AND DRIVING METHOD THEREOF

This application claims the benefit of the Korean Patent Application No. 2005-00134838 filed in Korea on Dec. 30, 2005, which is hereby incorporated by reference.

BACKGROUND OF THE INVENTION

1. Field of the Invention

The present invention relates to a liquid crystal display device, and more particularly to a liquid crystal display device and a driving method thereof that effectively adjusts to variations in size and/or resolution.

2. Discussion of the Related Art

Recent advancements in semiconductor technology have allowed development of a variety of electronics devices having small size, thin profile, light weight, low required voltage, and low power consumption. Accordingly, a need for flat panel display devices suitable for these new electronic devices has arisen. In particular, some of the developed flat panel display devices include liquid crystal display (LCD) devices, plasma display panel (PDP) devices, and organic electro-luminescent display (OELD) devices. Of the flat panel display devices, the LCD devices have received the most attention as LCD devices can be made thin and lightweight with relative ease while having small power consumption and low driving voltages.

FIG. 1 is a view illustrating an LCD device of the related art. As shown in FIG. 1, the LCD device of the related art has an LCD panel 110 on which images are displayed, a gate driver 120, and a data driver 130 for driving the LCD panel 110.

The LCD panel 110 has a front substrate and a rear substrate bonded together with a gap therebetween and a liquid crystal layer formed in the gap between the front substrate and the rear substrate. The front substrate is a color filter substrate. The front substrate typically includes red, green, and blue color filter layers for representing colors, a black matrix layer for shielding light between pixel regions, and a common electrode. The rear substrate is typically a thin film transistor (TFT) array substrate. In particular, the TFT array substrate includes a plurality of gate lines 111, a plurality of data lines 112 crossing the gate lines 111, a plurality of pixel electrodes formed at respective pixels at which the gate lines 111 and the data lines 112 cross each other, and a plurality of thin film transistors (TFTs) for transferring image signals from the data lines 112 to the pixel electrodes, respectively.

The gate driver 120 sequentially supplies gate signals to the plurality of gate lines 111. The data driver 130 supplies data signals to the plurality of data lines 112 with picture data voltages allocated to each pixel. The data signals are transferred to the respective pixel electrodes through the data lines 112 and the TFTs that are turned on by the gate signals. Different voltage levels representing the images are applied to the pixel electrodes and the common electrode. The orientation of liquid crystal molecules of the liquid crystal layer is changed based on these voltage levels. Accordingly, images are displayed by controlling an amount of light that pass through the liquid crystal display panel depending on the changed molecular orientation.

LCD devices with various screen sizes and/or resolutions are required depending on the diverse applications. As the screen size and/or resolution changes, so does the number of the gate lines 111 formed in the LCD panel. Accordingly, the number of the gate channels 121 of a corresponding gate driver also changes. Therefore, in the related art, the design time and manufacturing unit cost increase as the number of the gate channels 121 formed in the gate driver must be changed according to the LCD panel.

SUMMARY OF THE INVENTION

Accordingly, the present invention is directed to a liquid crystal display (LCD) device and driving method thereof that substantially obviates one or more problems due to limitations and disadvantages of the related art.

An object of the present invention is to provide an LCD device and driving method thereof to effectively adjust with variations in the size and/or resolution of an LCD panel.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the liquid crystal display device includes a liquid crystal display panel having a number of gate lines, a gate driver having a number of gate channels wherein the number of gate channels is different than the number of gate lines, and a timing controller to apply a gate shift clock signal to the gate driver, the gate shift clock signal having at least one dummy shift clock signal.

In another aspect, the method for driving of a liquid crystal display device includes the steps of calculating a difference value between a number of gate lines in a liquid crystal display panel and a number of gate channels in a gate driver, generating a gate shift clock signal having at least one dummy shift clock signal corresponding to the difference value, and supplying gate signals to the gate lines according to the gate shift clock signal.

In yet another aspect, the driving circuit for driving a liquid crystal panel in a liquid crystal display device includes a gate driver to apply gate signals to the liquid crystal display panel, the gate driver having a number of gate channels, the number of gate channels being different than a number of gate lines in the liquid crystal display panel, and a timing controller to apply a gate shift clock signal to the gate driver, the gate shift clock signal having at least one dummy shift clock signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
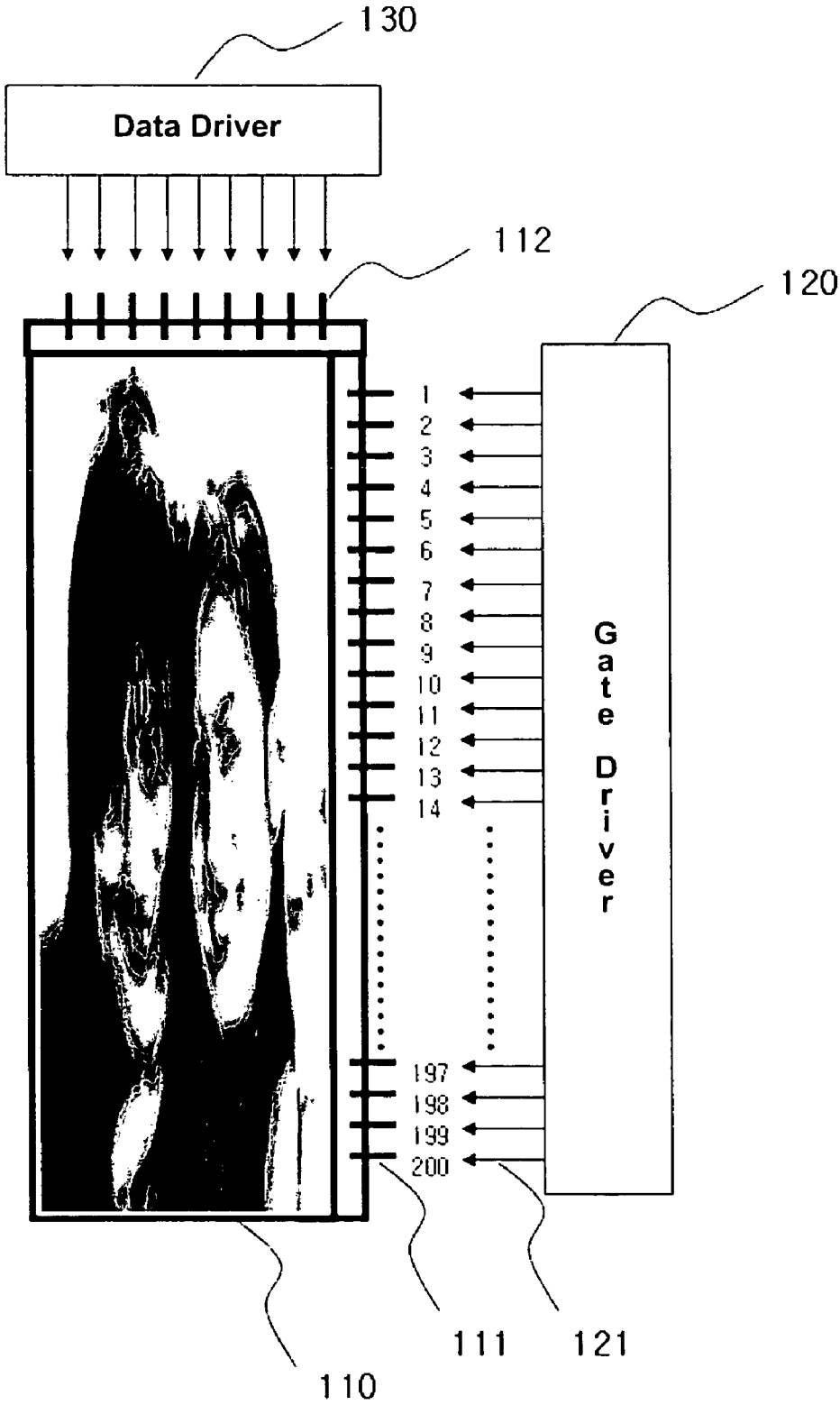
FIG. 1 RELATED ART
FIG. 1 is a view illustrating a liquid crystal display device of the related art.
Figure 2:
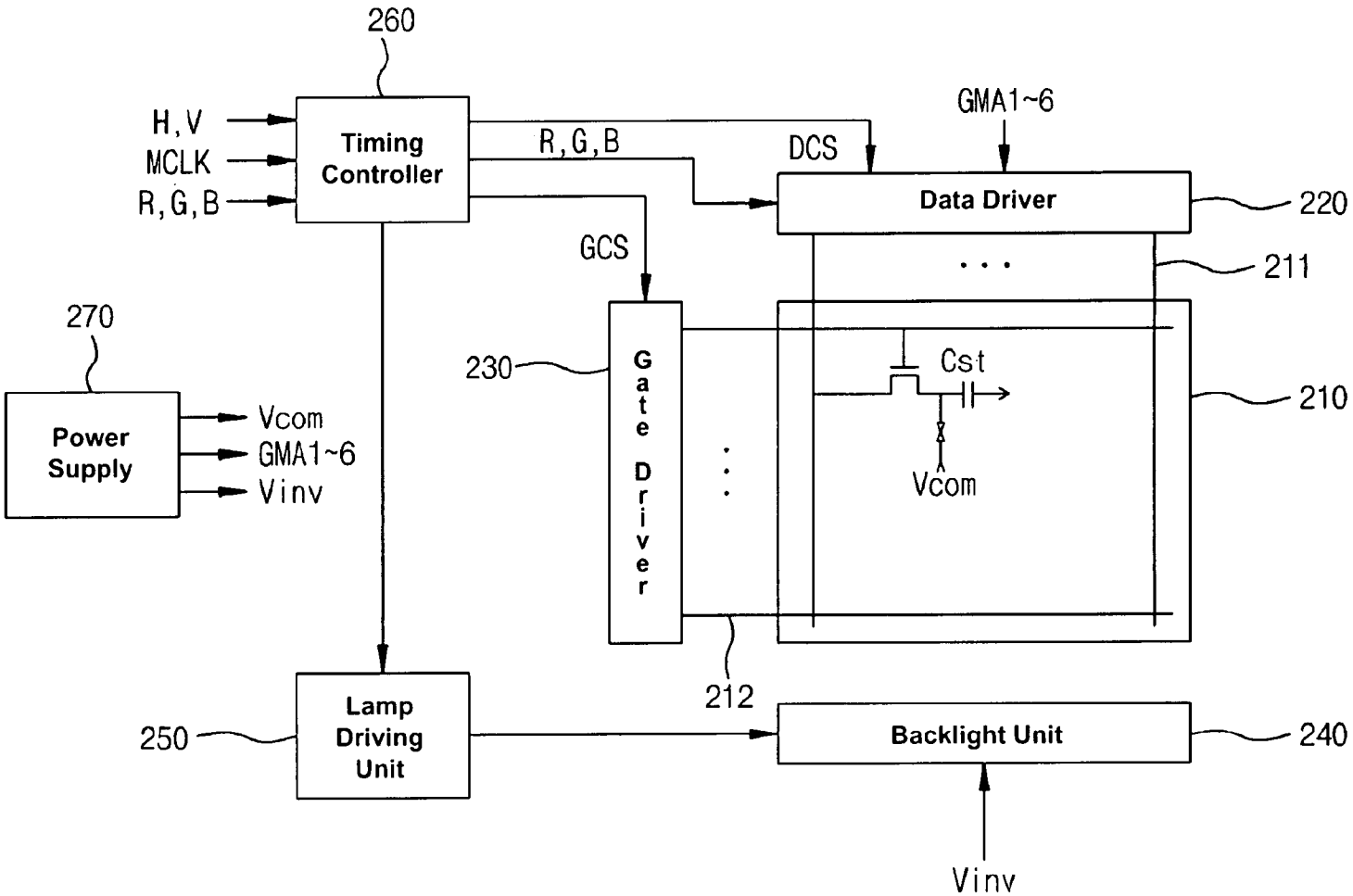
FIG. 2 is a block diagram of a liquid crystal display device according to an embodiment of the present invention.

FIG. 2 is a block diagram of a liquid crystal display (LCD) device according to an embodiment of the present invention. As shown in FIG. 2, the LCD device according to the embodiment of the present invention includes an LCD panel 210 in which a plurality of data lines 211 and a plurality of gate lines 212 cross each other and thin film transistors (TFTs) are formed at the intersections of the data lines 211 and the gate lines 212. A data driver 220 inputs data signals to the data lines 211 of the LCD panel 210, and a gate driver 230 inputs gate signals to the gate lines 212 of the LCD panel 210. A backlight unit 240 irradiates light onto the LCD panel 210, and a lamp driving unit 250 drives the lamp of the backlight unit 240. A timing controller 260 controls the data driver 220, the gate driver 230, and the lamp driving unit 250 of the LCD panel 210, and a power supply 270 supplies power to the LCD panel 210 and the backlight unit 240.

The LCD panel 210 includes a front substrate and a rear substrate bonded together to form a gap between the front and rear substrate. A liquid crystal material is injected into the gap between the front substrate and a rear substrate. The TFTs formed at the intersections of the data lines 211 and the gate lines 212 of the LCD panel 210 input data signals from the data lines 211 to liquid crystal cells in response to the gate signals from the gate driver 230. The TFTs include source electrodes connected to the data lines 211, drain electrodes connected to pixel electrodes (not shown) of the liquid crystal cells, and gate electrodes connected to the gate lines 212.

The timing controller 260 realigns digital video data received from a digital video card (not shown) on a red (R), green (G), and blue (B) basis. The data realigned by the timing controller 260 are stored in the timing controller 260 on the red, green, and blue data basis. The stored red, green, and blue data are input to the data driver 220.

Furthermore, the timing controller 260 generates a data control signal (DCS) using horizontal and vertical sync signals (H, V) and a main clock signal (MCLK) and supplies the generated data control signal (DCS) to the data driver 220. In particular, the data control signal (DCS) includes a dot clock signal (DCLK), a source shift clock signal (SSC), a source out enable signal (SOE), and a polarity inversion signal (POL), and is input to the data driver 220.

The timing controller 260 also generates a gate control signal (GCS) and supplies the generated gate control signal (GCS) to the gate driver 230. The gate control signal (GCS) includes a gate shift clock signal (GSC) and a gate out enable signal (GOE) and is input to the gate driver 230.

The data driver 220 samples image data according to the data control signal (DCS) from the timing controller 260 and latches the sampled data on a one-line basis every horizontal period. Furthermore, the data driver 220 converts the digital pixel data (R, G, and B) received from the timing controller 260 into analog pixel signals using gamma voltages (GMA1 to 6) from the power supply 270 and supplies the converted signals to the data lines 211.

The gate driver 230 has a shift register that sequentially generates the gate pulses in response to the gate control signal (GCS) from the timing controller 260 and a level shifter that shifts a voltage of the gate signal to a voltage level suitable to drive the liquid crystal cell. Furthermore, the gate driver 230 sequentially supplies gate high voltages to the gate lines 212 in response to the gate control signal (GCS).

The backlight unit 240 has a lamp (not shown) for irradiating light onto the LCD panel 210 and a lamp inverter for driving the lamp. The lamp generates light using a driving voltage from the lamp inverter. The lamp inverter drives the lamp using a lamp driving voltage (Vinv) from the power supply 270. In addition to the lamp driving voltage (Vinv), the power supply 270 supplies the LCD panel 210 with a common electrode voltage (Vcom) and the data driver 220 with the gamma voltages (GMA1 to 6).

In accordance with the present invention, the screen size and/or resolution of the LCD panel 210 may be changed in various ways without hardware modification of the LCD device. In particular, the number of the gate lines 212 may change depending on the LCD panel 210 while the number of the gate channels of the corresponding gate driver 230 is fixed. Accordingly, even if the number of the gate lines 212 and the number of the gate channels of the gate driver 230 do not match (e.g., the number of the gate channels of the gate driver 230 is different from that of the gate lines 212 of the LCD panel 210), the LCD panel 210 can be controlled by changing the control signals of the timing controller 260 according to the present invention.

More specifically, the timing controller 260 causes at least one dummy shift clock signal (DSC) to be included in the gate shift clock signal (GSC). That is, the dummy shift clock signal (DSC) is included in the gate shift clock signal (GSC) that controls the gate lines 212 to be shifted in order to sequentially supply the gate signals to the gate lines 212 every horizontal period (1H). The gate channel of the gate driver 230 controlled by the dummy shift clock signal (DSC) is not used, and control is immediately shifted to the next gate channel. Accordingly, the dummy shift clock signal (DSC) allows the number of gate lines and the number of gate channels to be matched. This will be described in more detail below with reference to FIGS. 3 to 5.

Figure 3:
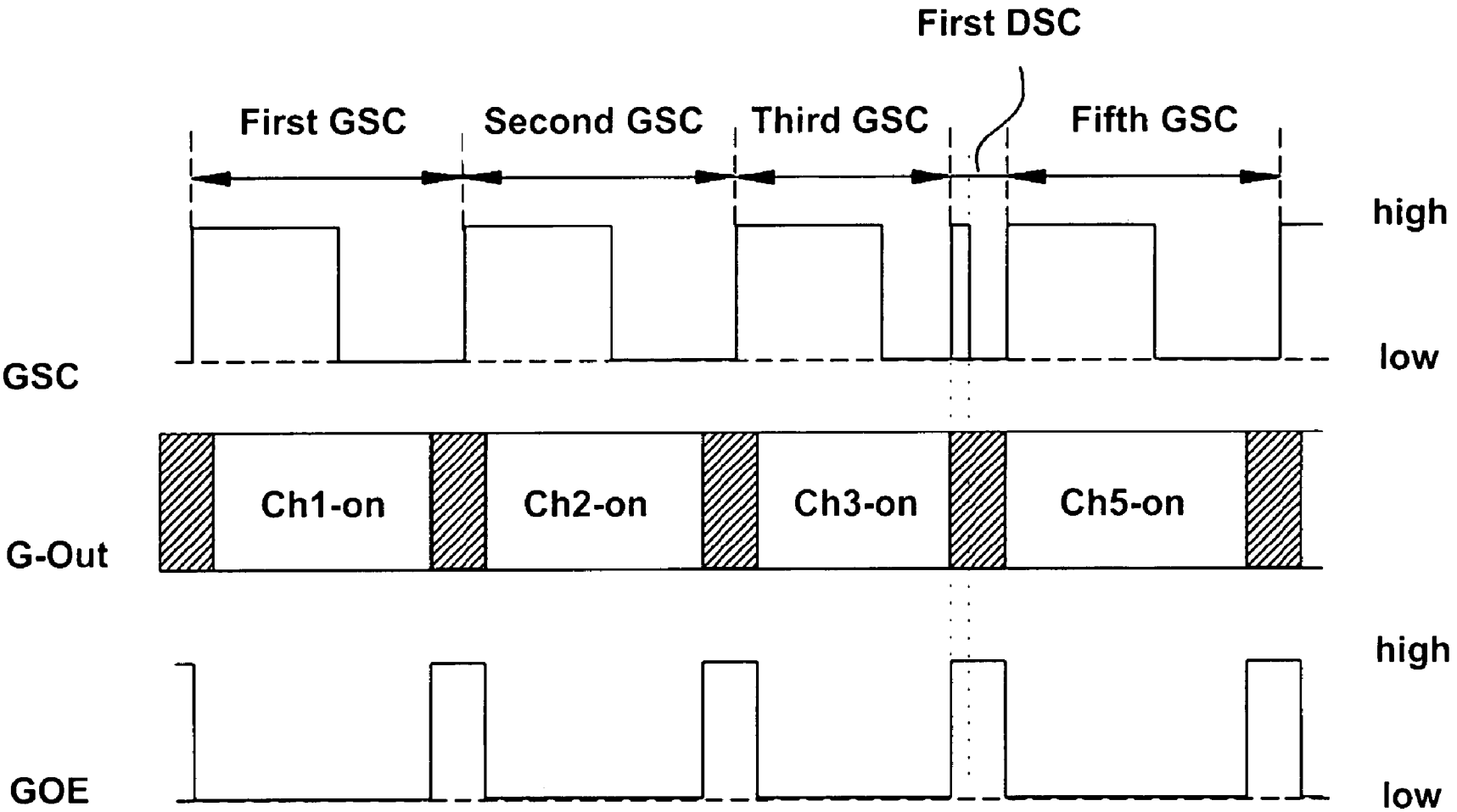
FIG. 3 is a diagram illustrating an operation characteristic of a timing controller according to an embodiment of the present invention.

FIG. 3 is a diagram illustrating an operational characteristic of a timing controller according to an embodiment of the present invention. As shown in FIG. 3, the timing controller 260 generates the gate control signal (GCS) having the gate shift clock signal (GSC) and the gate out enable signal (GOE) and supplies the generated gate control signal (GCS) to the gate driver 230. The gate output (G-Out) refers to the period of gate signals which are output through the gate channels of the gate driver 230. The gate channels are substantially selected according to the gate shift clock signal (GSC) and the gate output enable signal (GOE).

The gate shift clock signal (GSC) has a gate shift clock of one cycle, which refers to the period from the time when a high signal is generated to the time when a next high signal is generated. The gate shift clock (GSC) of one cycle sets one horizontal period (1H) and shifts one gate channel whenever one horizontal period is finished. According to the present invention, the gate shift clock signal (GSC) includes at least one dummy shift clock signal (DSC).

The gate output enable signal (GOE) is a signal for controlling a width of a gate signal output from the gate driver 230. That is to say, when the gate driver 230 supplies the gate signals to one of the gate lines 212 every horizontal period in synchronization with the gate shift clock signal (GSC), the gate driver 230 stops the supply of the gate signal to the gate lines 212 while the gate output enable signal (GOE) is high. Accordingly, the gate signals supplied to the gate lines 212 can be prevented from overlapping.

In accordance with the present invention, when the number of the gate lines 212 in the LCD panel 210 is different from that of the gate channels, the gate driver 230 having a greater number of gate channels than that of the gate lines 212 may be used to drive the LCD panel 210. Gate channels connected to the gate lines 212 are controlled to be used, and gate channels that are not connected to the gate lines 212 are controlled not to be used.

Accordingly, the timing controller 260 generates the gate shift clock signal (GSC) of one cycle in order to drive the gate channels that are actually connected to the date lines 212. The timing controller 260 also selectively generates the dummy shift clock signal (DSC) in order to control the gate channels that are not connected to the data lines 212. In particular, the dummy shift clock signal (DSC) is a signal having a width narrower than that of the gate shift clock signal (GSC). The dummy shift clock signal (DSC) is selectively placed between the gate shift clock signals (GSC) in locations of the unconnected gate channels, and the signals are then applied to the gate driver 230. As a result, gate signals are not output to the gate channels during the dummy shift clock signal (DSC) signal. Accordingly, the number of the dummy shift clock signal (DSC) per one cycle through all the gate channels according to the embodiment of the present invention is the same as the number of gate channels that will not be used (i.e., a difference value between the number of gate lines and the number of gate channels).

The supply of the gate signals to the gate lines must be stopped in order to shift the gate lines. Accordingly, the dummy shift clock signal (DSC) is generated during a period in which one gate out enable signal (GOE) has a high value. In addition, the dummy shift clock signal (DSC) may be generated at every predetermined gate shift clock signal (GSC) cycle corresponding to non-used gate channels. For example, the dummy shift clock signal (DSC) may be generated at every one or more repetitive cycles. Alternatively, the dummy shift clock signal (DSC) may be generated irregularly.

The operational characteristic of the timing controller 260 will be described below in detail with reference to FIG. 3. As shown in FIG. 3, a fourth gate channel is designated as not being used for purposes of example only. A first gate shift clock signal ("first GSC"), a second gate shift clock signal ("second GSC"), and a third gate shift clock signal ("third GSC") are sequentially applied. Thereafter, the first dummy shift clock signal ("first DSC") is applied and a fifth gate shift clock signal ("fifth GSC") is then applied. During the application of the gate shift clock signals including the dummy shift clock signal (DSC), the gate output enable signal (GOE) having a high value is applied during a period before and after each gate shift clock signal (GSC) begins and ends to stop the supply of the gate signal to the gate driver 230. As shown in the gate out (G-OUT) period, a first gate channel is turned on (Ch1-on) during the first gate shift clock signal ("first GSC"), a second gate channel is turned on (Ch2-on) during the second gate shift clock signal ("second GSC"), a third gate channel is turned on (Ch3-on) during the third gate shift clock signal ("third GSC"), and a fifth gate channel is turned on (Ch5-on) during the fifth gate shift clock signal ("fifth GSC") in each horizontal period (1H). The first dummy shift clock signal ("first DSC") allowed the fourth gate channel to be skipped over, thereby preventing the fourth gate channel (not shown) from being used.

Figure 4:
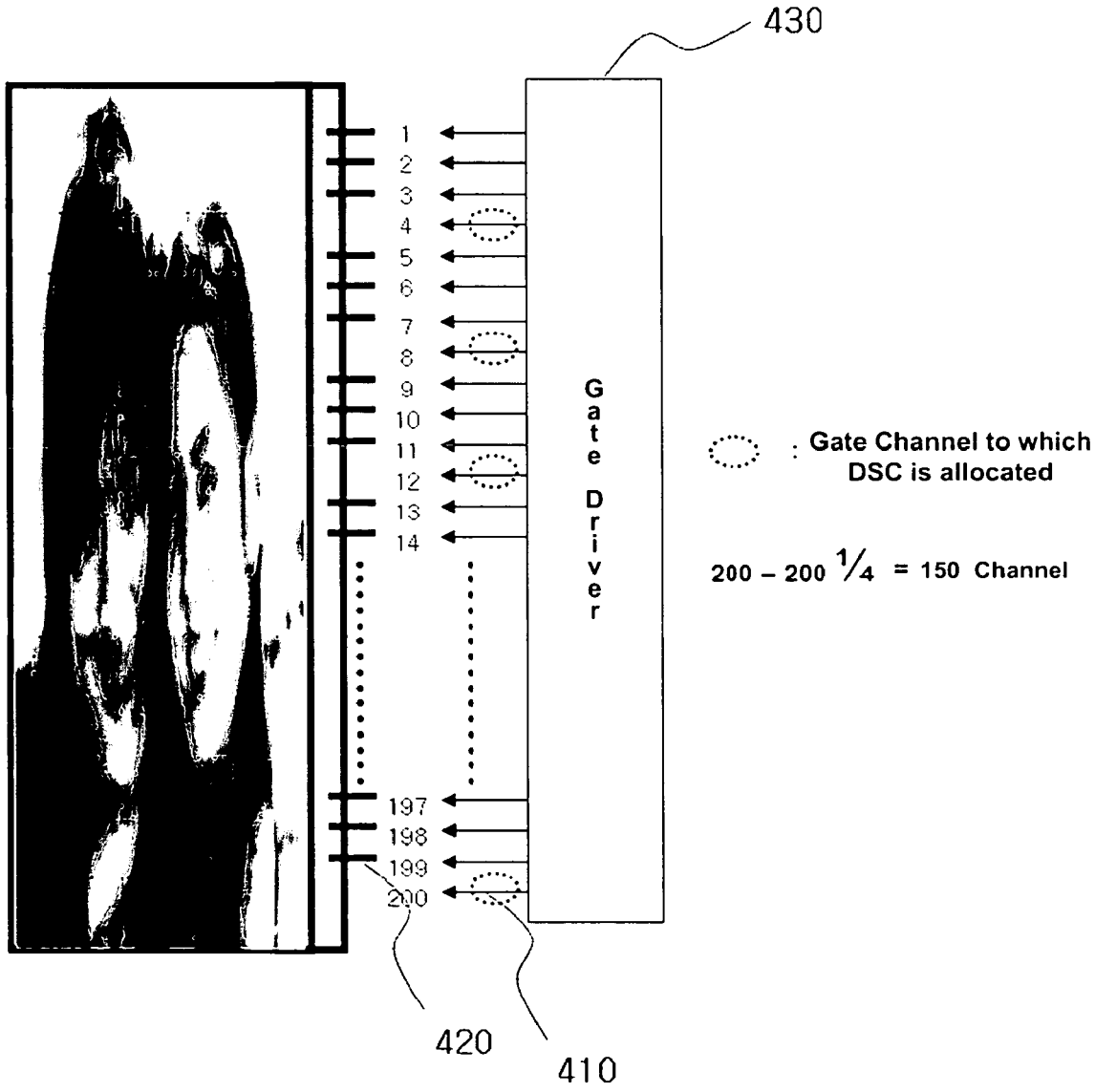
FIG. 4 is a view illustrating a driving method of the liquid crystal display device according to an embodiment of the present invention.

FIG. 4 is a view illustrating a driving method of the liquid crystal display according to an embodiment of the present invention. For purposes of example only, FIG. 4 shows a gate driver 430 having two hundred (200) gate channels 410 and an LCD panel having one hundred fifty (150) gate lines 420. Accordingly, every fourth gate channel is not needed to drive the 150 gate lines in the LCD panel. Therefore, every fourth gate channel of gate channels 410 is not connected to the gate lines 420. Hence, the gate driver 430 is supplied with three consecutive gate shift clock signals (GSC) followed by one dummy shift clock signal (DSC). In effect, a virtual signal is put into one of the four gate channels to force a shift to the next gate channel, thereby skipping the unnecessary gate channel. Gate signals necessary for gate lines are then supplied.

To this end, the driving method of the LCD device according to an embodiment of the present invention includes the step of calculating a difference value between the number of gate lines and the number of gate channels, generating the gate shift clock signal (GSC) having at least one dummy shift clock signal (DSC) based on the difference value, and supplying gate signals to the gate lines according to the gate shift clock signal (GSC).

As described above, by changing the timing control signal, an LCD device having gate lines and gate channels with different numbers can be driven without changing the hardware configuration. Accordingly, an LCD device can be driven efficiently depending on the size and/or resolutions of the LCD panel.

Figure 5:
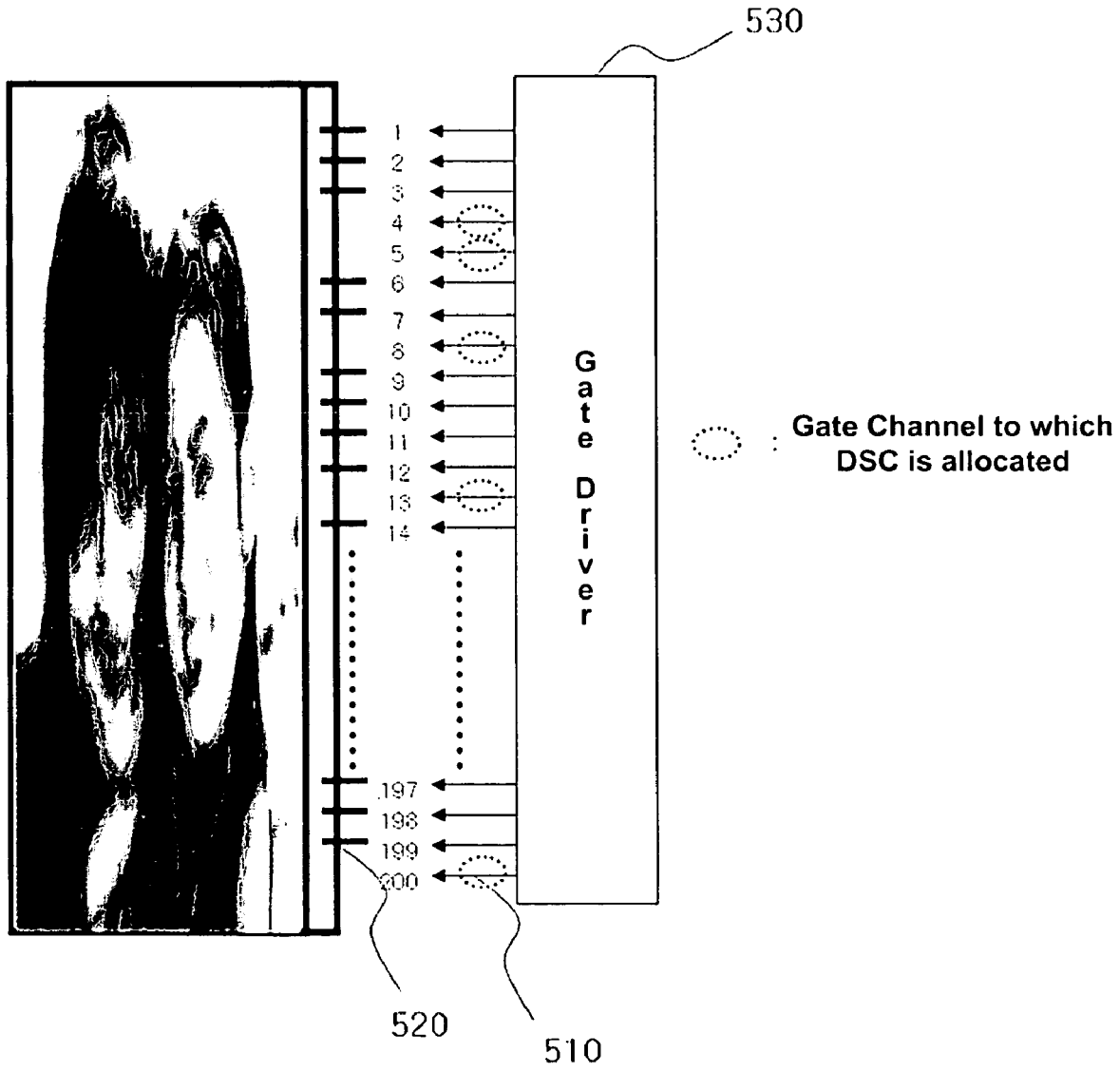
FIG. 5 is a view illustrating a driving method of the liquid crystal display device according to another embodiment of the present invention.

FIG. 5 is a view illustrating a driving method of the liquid crystal display according to another embodiment of the present invention. For purposes of example only, FIG. 5 shows an LCD device with a gate driver 530 having two hundred (200) gate channels 510 and an LCD panel having one hundred forty-nine (149) gate lines 520. Accordingly, fifty-one (51) gate channels are not needed to drive the LCD panel. In accordance with an alternative embodiment of the present invention, a method of allocating a dummy shift clock signal (DSC) to the unused gate channels 510 of the gate driver 530 can be varied.

For example, the dummy shift clock signal (DSC) can be allocated to the gate channels 510 in regularly spaced cycles of gate shift clock signal (GSC) stream, similar to the embodiment described above with reference to FIG. 4. Alternatively, the dummy shift clock signal (DSC) may be irregularly allocated to the gate channels 510 by including the dummy shift clock signal (DSC) in specifically designated locations within the gate shift clock signal (GSC) stream. For instance, as shown in FIG. 5, the dummy shift clock signal (DSC) may be allocated consecutively in the fourth and fifth slots of the gate shift clock signal (GSC) stream while allocating the eighth and thirteenth slots as the next two gate channels to be skipped.

In the alternative embodiment, the number of the dummy shift clock signal (DSC) per one cycle through all the gate channels is the same as a difference value between the number of gate lines and the number of gate channels, and a width of the dummy shift clock signal (DSC) signal is smaller than that of one gate shift clock signal (GSC). Furthermore, an application time of the dummy shift clock signal (DSC) is included within a period when the gate out enable signal (GOE) is applied to stop the supply of the gate signals to the gate lines.

As described above, by improving the LCD device and the driving method thereof according to the embodiments of the present invention, variations of the size and/or resolution of the LCD panels used in the LCD device can be adapted effectively. Furthermore, gate lines and gate channels having different numbers can be driven efficiently.

It will be apparent to those skilled in the art that various modifications and variations can be made in the LCD device of the present invention and the driving method thereof without departing form the spirit or scope of the invention. Thus, it is intended that the present invention cover the modifications and variations of this invention provided they come within the scope of the appended claims and their equivalents.

What is claimed is:

1. A liquid crystal display device, comprising:

a liquid crystal display panel having a number of gate lines;

a gate driver having a number of gate channels, wherein the number of gate channels is different than the number of gate lines; and a timing controller to apply a plurality of gate shift clock signals to the gate driver, at least one gate shift clock signal having at least one dummy shift clock signal, wherein the timing controller applies the dummy shift clock signal while a gate out enable signal having a high logical value is applied to the gate driver for stopping the supply of the gate pulse to the gate lines, and wherein the gate out enable signal is shifted to the high logical value between each of the plurality of gate shift clock signals not having a dummy shift clock signal.

2. The liquid crystal display device as claimed in claim 1, wherein the number of the gate channels is greater than the number of the gate lines.

3. The liquid crystal display device as claimed in claim 1, wherein the number of the dummy shift clock signal per one cycle through the gate channels is the same as a difference value between the number of the gate lines and the number of the gate channels.

4. The liquid crystal display device as claimed in claim 1, wherein the dummy shift clock signal has a signal width narrower than that of one gate shift clock.

5. The liquid crystal display device as claimed in claim 1, wherein the dummy shift clock signal is in a regular, even interval within the gate shift clock signal.

6. A driving circuit for driving a liquid crystal panel in a liquid crystal display device, comprising:

a gate driver to apply gate signals to the liquid crystal display panel, the gate driver having a number of gate channels, the number of gate channels being different than a number of gate lines in the liquid crystal display panel; and a timing controller to apply a plurality of gate shift clock signals to the gate driver, at least one gate shift clock signal having at least one dummy shift clock signal, wherein the timing controller applies the dummy shift clock signal while a gate out enable signal having a high logical value is applied to the gate driver for stopping the supply of the gate pulse to the gate lines, and wherein the gate out enable signal is shifted to the high logical value between each of the plurality of gate shift clock signals not having a dummy shift clock signal.

7. The driving circuit as claimed in claim 6, wherein the number of the gate channels is greater than the number of the gate lines.

8. The driving circuit as claimed in claim 6, wherein the number of the dummy shift clock signal per one cycle through the gate channels is the same as a difference value between the number of the gate lines and the number of the gate channels.

9. The driving circuit as claimed in claim 6, wherein the dummy shift clock signal has a signal width narrower than that of one gate shift clock.

* * * * *